US006323628B1

(12) United States Patent
Park

(10) Patent No.: US 6,323,628 B1
(45) Date of Patent: Nov. 27, 2001

(54) VOLTAGE REGULATOR

(75) Inventor: Joshua C. Park, Madford, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/608,764

(22) Filed: Jun. 30, 2000

(51) Int. Cl.[7] ..... G05F 1/40
(52) U.S. Cl. ..... 323/281; 323/313; 327/513
(58) Field of Search ..... 323/281, 282, 323/284, 273, 313, 314, 315, 907; 327/513, 378, 512

(56) References Cited

U.S. PATENT DOCUMENTS 5,241,261 * 8/1993 Edwards et al. ..... 323/313
5,309,083 * 5/1994 Pierret et al. ..... 323/313
5,424,628 * 6/1995 Nguyen ..... 323/314
5,559,425 * 9/1996 Allman ..... 323/315
5,686,821 11/1997 Brokaw .
5,731,696 * 3/1998 Pennisi et al. ..... 323/313
5,737,170 * 4/1998 Moyer ..... 361/103
5,796,244 * 8/1998 Chen et al. ..... 323/313

* cited by examiner

*Primary Examiner*—Rajnikant B. Patel
(74) *Attorney, Agent, or Firm*—Ratner & Prestia; Joseph P. Abate, Esq.

(57) ABSTRACT

A voltage regulator that establishes a bandgap voltage reference and achieves output voltage regulation with a single feedback loop. The bandgap voltage reference is established by equal current flow through each of two branches of a proportional to absolute temperature current mirror. The equal current flow through the two branches of the proportional to absolute temperature current mirror is achieved by the feedback loop controlling the current flow in response to the bandgap voltage reference. This same feedback loop, responsible for establishing the bandgap voltage, also establishes the regulated output voltage through a pass transistor by means of maintaining a fixed voltage ratio between the bandgap voltage and the regulated output voltage through a resistor string.

13 Claims, 4 Drawing Sheets

VOLTAGE REGULATOR

TECHNICAL FIELD

The present invention relates, in general, to voltage regulators that develop a regulated output voltage in response to a bandgap voltage reference and, in particular, to a voltage regulator that establishes bandgap voltage reference and achieves output voltage regulation with a single feedback loop.

BACKGROUND OF THE INVENTION

A voltage regulator accepts an unregulated and noisy supply voltage as an input and generates an accurate and well-defined output voltage with a rated current capacity. Generally, conventional voltage regulators consist of two functional parts, namely a bandgap voltage reference generation circuit and a voltage regulation circuit. FIG. 1 shows a conventional voltage regulator. In the FIG. 1 voltage regulator, each of the two parts has a separate feedback loop, where the noise and inaccuracy of each part cumulatively degrades the final, regulated output voltage.

U.S. Pat. No. 5,686,821 to Brokaw discloses a voltage regulator that has a single feedback loop. A defined bandgap voltage is not required in this voltage regulator. Instead, a separate proportional to absolute temperature voltage sensing stage is included along with a high-gain transconductance amplifier having an input offset voltage that cancels the proportional to absolute temperature voltage generated in the proportional to absolute temperature voltage sensing stage. The voltage regulator of U.S. Pat. No. 5,686,821 relies heavily on the accurate cancellation in one stage of the proportional to absolute temperature voltage generated in a different stage. In addition, the design of the voltage regulator of U.S. Pat. No. 5,686,821 requires a very high-gain transconductance amplifier to achieve the strong feedback loop required for accurate voltage regulation.

SUMMARY OF THE INVENTION

To overcome the shortcomings of prior art voltage regulators, a new and improved voltage regulator is provided by the present invention. One object of the present invention is to provide a new and improved voltage regulator. Another object of the present invention is to provide a voltage regulator that has improved efficiency. A further object of the present invention is to provide a voltage regulator that has improved accuracy. Yet another object of the present invention is to provide a voltage regulator that does not suffer from error accumulation.

A voltage regulator, constructed in accordance with the present invention, includes a proportional to absolute temperature current mirror having first and second current branches for establishing a bandgap voltage when current flow through the first and second current branches is equal and a resistor string coupled to the proportional to absolute temperature current mirror and responsive to the bandgap voltage for developing a regulated voltage from the bandgap voltage that is supplied to a load. Also included in this voltage regulator are output means between the proportional to absolute temperature current mirror and the resistor string for supplying output current to the load while maintaining the regulated voltage constant and an inverting gain stage coupled to the proportional to absolute temperature current mirror for sensing relative current flow through the first and second current branches in the proportional to absolute temperature current mirror and for controlling the output means to maintain the regulated voltage constant. A voltage regulator, constructed in accordance with the present invention, further includes a start up circuit responsive to the regulated voltage and coupled to the proportional to absolute temperature current mirror for initiating current flow through the first and second current branches in the proportional to absolute temperature current mirror.

It is to be understood that the foregoing general description of the invention and the following detailed description of the invention are exemplary, but are not restrictive of the invention.

BRIEF DESCRIPTION OF THE DRAWINGS

The present invention is best understood from the following detailed description when read in conjunction with the accompanying drawings. Included in the drawings are the following figures.

DETAILED DESCRIPTION OF THE INVENTION

Figure 2:
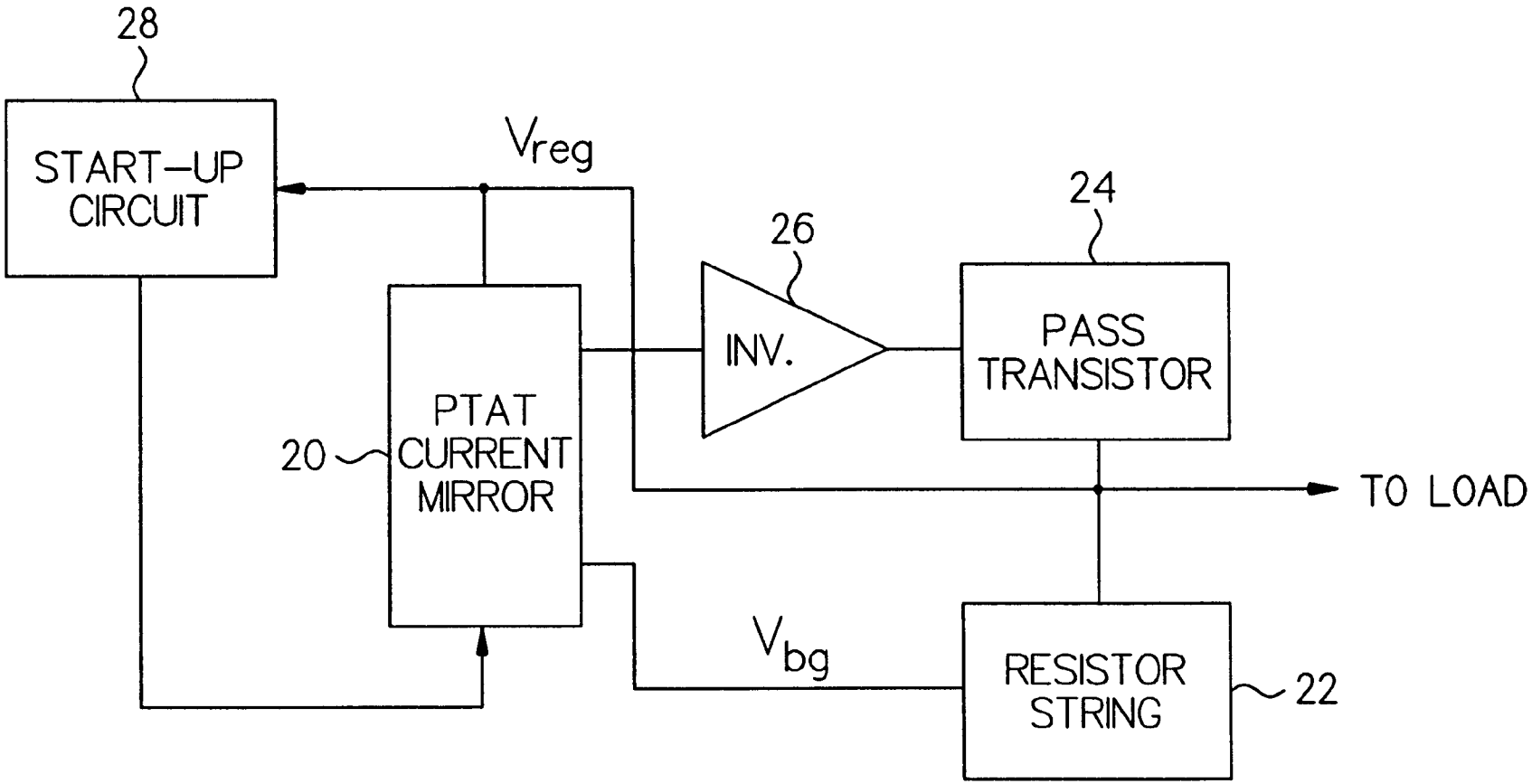
FIG. 2 is a block diagram of a voltage regulator constructed in accordance with the present invention.

Referring to FIG. 2, a voltage regulator, constructed in accordance with the present invention, includes a proportional to absolute temperature current mirror 20 that has first and second current branches, not shown in FIG. 2. The currents flowing through the two current branches in proportional to absolute temperature current mirror 20 are proportional to the absolute temperature of the environment in which the voltage regulator is located. Proportional to absolute temperature current mirror establishes a bandgap voltage when current flow through the first and second current branches is equal. The details of proportional to absolute temperature current mirror 20 will be considered in greater detail below in connection with FIG. 3.

The FIG. 2 voltage regulator also has a resistor string 22 coupled to proportional to absolute temperature current mirror 20. Resistor string 22 is responsive to the bandgap voltage established by proportional to absolute temperature current mirror 20 and develops a regulated voltage from the bandgap voltage that is supplied to a load. The details of resistor string 22 will be considered in greater detail below in connection with FIG. 3.

Also included in a voltage regulator, constructed in accordance with the present invention, are output means, identified as a pass transistor 24, between proportional to absolute temperature current mirror 20 and resistor string 22. Output means 24 provide output current to a load while maintaining the regulated voltage constant. The details of output means 24 will be considered in greater detail below in connection with FIG. 3.

The FIG. 2 voltage regulator further includes an inverting gain stage 26 coupled to proportional to absolute temperature current mirror 20 for sensing relative current flow through the first and second current branches in the proportional to absolute temperature current mirror and for controlling output means 24 to maintain the regulated voltage constant. The details of inverting gain stage 26 will be considered in greater detail below in connection with FIG. 3.

A voltage regulator, constructed in accordance with the present invention, also includes a start up circuit 28, responsive to the regulated voltage and coupled to proportional to absolute temperature current mirror 20 for initiating current flow through the first and second current branches in the proportional to absolute temperature current mirror. The details of start up circuit 28 will be considered in greater detail below in connection with FIG. 3.

Figure 3:
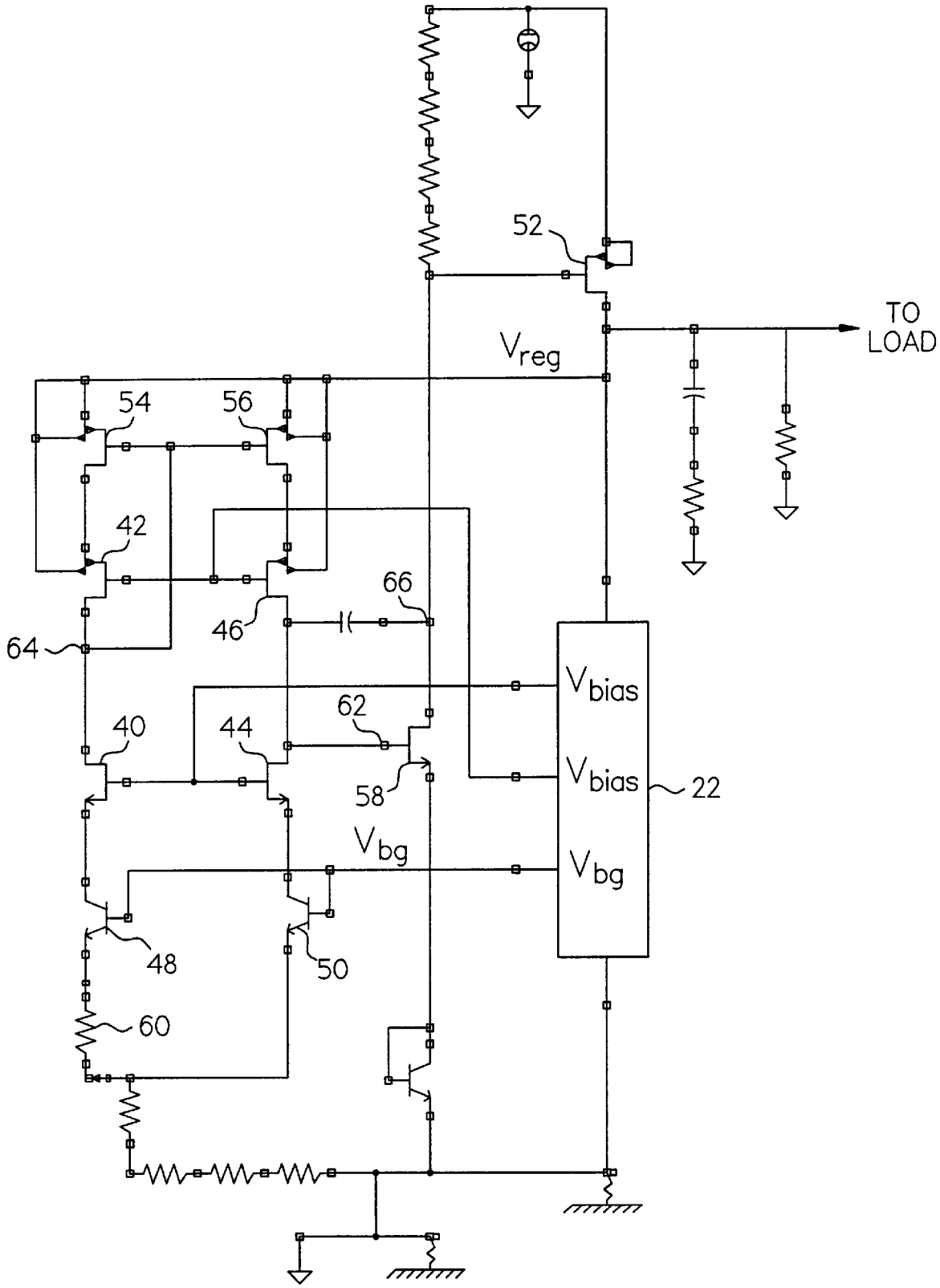
FIG. 3 is a circuit diagram of a preferred embodiment of a portion of the FIG. 2 voltage regulator constructed in accordance with the present invention.
Figure 4A:
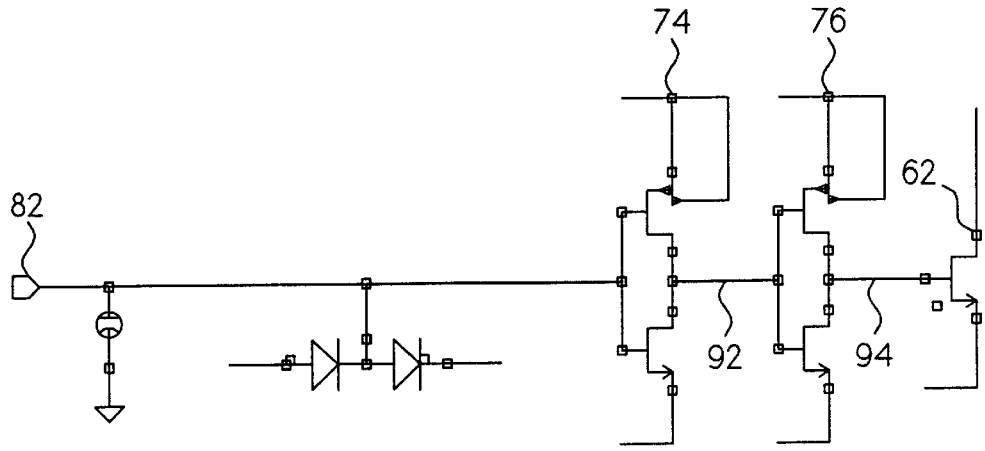
FIGS. 4A through 4D are circuit diagrams of a preferred embodiment of a start up circuit portion of the FIG. 2 voltage regulator constructed in accordance with the present invention.
Figure 4B:
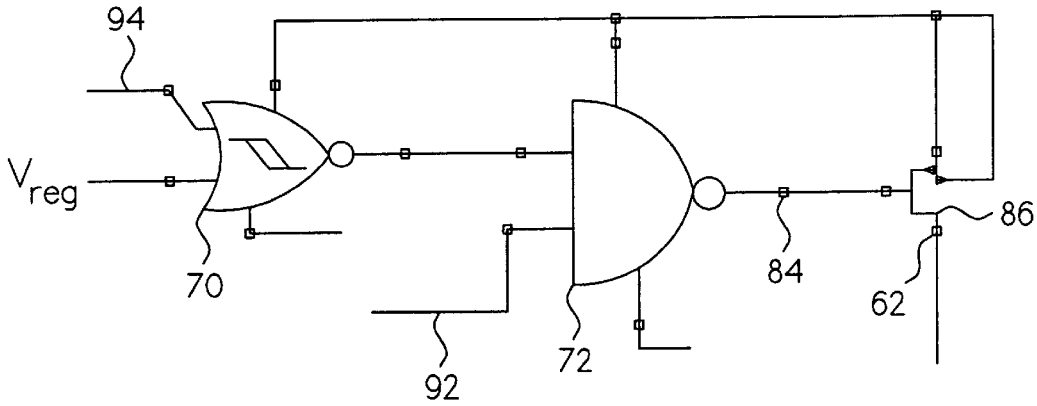
Figure 4C:
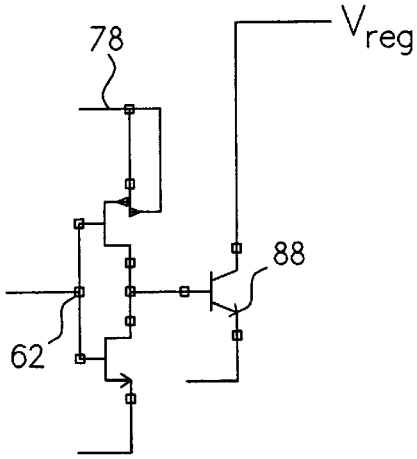
Figure 4D:
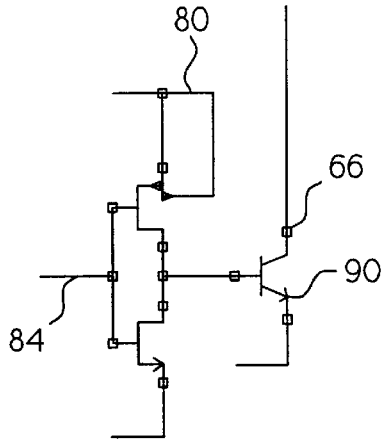

The FIG. 3 circuit diagram shows a portion of a preferred embodiment of the FIG. 2 voltage regulator. Referring to FIG. 3, proportional to absolute temperature current mirror 20 of FIG. 2 can include a cascoded current mirror comprising FET transistors 40, 42, 44 and 46. FET transistor 40 and 42 are included in the first current branch in proportional to absolute temperature current mirror 20 and FET transistors 44 and 46 are included in the second current branch in proportional to absolute temperature current mirror 20.

Transistors 48 and 50 also are included, respectively, in the first and the second current branches in proportional to absolute temperature current mirror 20. When the current flow through the two current branches in proportional to absolute temperature current mirror 20 is equal, the bandgap voltage $V_{bg}$ is established at the junction of the bases of transistors 48 and 50.

Resistor string 22 of FIG. 2 is made up of a plurality of series-connected resistors and forms a third current branch of the circuit. The bandgap voltage established by proportional to absolute temperature current mirror 20 is applied to resistor string 22. The regulated voltage $V_{reg}$ is developed across resistor string 22 as shown in FIG. 3 from the bandgap voltage $V_{bg}$. Also as shown in FIG. 3, cascoded transistors 40, 42, 44 and 46 are biased by resistor string 22.

As shown in FIG. 3, output means 24 of FIG. 2 can include a FET transistor 52, identified as pass transistor 24 in FIG. 2. FET transistor 52 is connected between a pair of FET transistors 54 and 56, respectively, in the first and the second current branches of proportional to absolute temperature current mirror 20 and resistor string 22. For the embodiment of the invention illustrated in FIG. 3, the first current branch in proportional to absolute temperature current mirror 20 includes FET transistors 54, 42 and 40 connected in series and connected in series with transistor 48 and the second current branch in proportional to absolute temperature current mirror 20 includes FET transistors 56, 46 and 44 connected in series and connected in series with transistor 50.

As shown in FIG. 3, inverting gain stage 26 of FIG. 2 forms a fourth current branch of the circuit and can include a FET transistor 58. If, for example, the bandgap voltage $V_{bg}$ changes, the current flow through transistors 48 and 50 changes. The current flow through transistor48 in the first current branch of proportional to absolute temperature current mirror 20, however, does not change as rapidly as the change in current flow through transistor 50 in the second current branch in proportional to absolute temperature current mirror 20 because of the presence of a degeneration resistor 60 in the first current branch in proportional to absolute temperature current mirror 20.

The current flow through the two current branches in proportional to absolute temperature current mirror 20 is driven to being the same in the two current branches as the voltage level at a node 62 in inverting gain stage 26 changes relative to the voltage level at a node 64 in the first current branch in proportional to absolute temperature current mirror 20 where FET transistors 40 and 42 are connected. This is accomplished as follows.

As the regulated voltage $V_{reg}$ changes, the bandgap voltage $V_{bg}$ also changes causing changes in the current flow in the two current branches in proportional to absolute temperature current mirror 20. This change in the bandgap voltage $V_{bg}$, however, results in different amounts of changes in current flow in the two current branches in proportional to absolute temperature current mirror 20 due to the presence of degeneration resistor 60. Degeneration resistor 60 makes the current flow in the first current branch in proportional to absolute temperature current mirror 20 a little less sensitive to the changes in the bandgap voltage $V_{bg}$, than in the second current branch in proportional to absolute temperature current mirror 20.

Corresponding to these changes in current flow in the two current branches in proportional to absolute temperature current mirror 20, the voltage at node 64 readjusts due to the change in current flow in the first branch forcing the current flow through FET transistors 54 and 56 to change according to the change in current flow through FET transistor 48 in the first current branch in proportional to absolute temperature current mirror 20. However, this adjusted current level is not sufficient to account for the change in current flow through FET transistor 50 in the second current branch in proportional to absolute temperature current mirror 20. As a result, the relative voltage level between nodes 62 and 64 changes.

This change is reflected at a node 66 in inverting gain stage 26 which, in turn, is reflected to pass transistor 24. Pass transistor 24, then, re-establishes the regulated voltage $V_{reg}$ to the proper level which, in turn, re-balances the current flow in the two current branches in proportional to absolute temperature current mirror 20. Cascoded transistors 40, 42, 44 and 46 help to increase the sensitivity of the changes in the relative voltage level between nodes 62 and 64 to the changes in the relative current flow in the two current branches in proportional to absolute temperature current mirror 20.

FIGS. 4A through 4D collectively show a preferred embodiment of start up circuit 28 of FIG. 2. Certain elements of the FIG. 3 circuit are identified in FIGS. 4A through 4D to indicate how the start up circuit of FIGS. 4A through 4D is connected to the circuit of FIG. 3. Certain elements are identified in FIGS. 4A through 4D to indicate how portions of the start up circuit are connected to one another.

Referring to FIGS. 4A through 4D, the start up circuit includes a Schmitt trigger NOR gate 70, a NAND gate 72 and a plurality of inverters 74, 76, 78 and 80. When the input signal at ON/OFF input terminal 82 is low, thereby turning the voltage regulator on, Schmitt trigger NOR gate 70 senses the regulated voltage $V_{reg}$ and if the regulated voltage $V_{reg}$ is not established properly as in the beginning of start up, a high level of start up current is injected at a node 84 through a FET transistor 86 and draws a high amount of current from node 66 through a transistor 88.

Both of these mechanisms help to raise the regulated voltage $V_{reg}$. Once the regulated voltage $V_{reg}$ is properly established, the start up circuit is disabled as the Schmitt trigger NOR gate 70 and NAND gate 72 are disabled.

Inverter circuit 78, along with transistor 88, speeds up shutting off the voltage regulator when desired.

Figure 1:
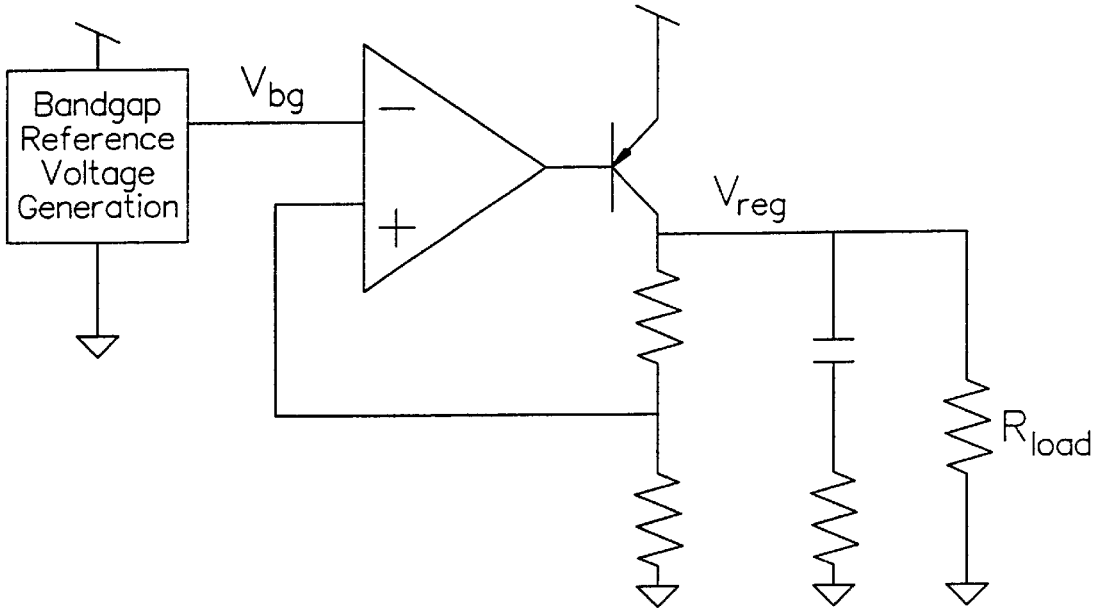
FIG. 1 PRIOR ART
FIG. 1 is a circuit diagram of a conventional voltage regulator.

In accordance with the present invention, the bandgap voltage and the regulated voltage are developed by a single feedback loop. By having a single feedback loop to develop both the bandgap voltage and the regulated voltage, this voltage regulator is more efficient. In addition, with only a single feedback loop, accuracy is improved because the voltage regulator does not suffer from the error accumulation problem that exists in conventional voltage regulators, such as the one illustrated by FIG. 1, that have two feedback loops.

The cascoded current mirror provides excellent proportional to absolute temperature current mirror matching in the two current branches of the proportional to absolute temperature current mirror 20. This improves the accuracy of the bandgap voltage. In addition, high voltage gain is obtained through the cascoded bandgap current mirror that achieves the high loop gain required in the feedback loop.

Although illustrated and described above with reference to certain specific embodiments, the present invention nevertheless is not intended to be limited to the details shown. Rather, various modifications may be made in the details within the scope and range of equivalents of the claims and without departing from the spirit of the invention.

What is claimed:

1. A voltage regulator comprising:

a proportional to absolute temperature current mirror having first and second current branches for establishing a bandgap voltage when current flow through said first current branch and said second current branch is equal;

a resistor string coupled to said proportional to absolute temperature current mirror and responsive to the bandgap voltage for developing a regulated voltage from the bandgap voltage that is supplied to a load;

output means between said proportional to absolute temperature current mirror and said resistor string for supplying output current to the load while maintaining the regulated voltage constant;

an inverting gain stage coupled to said proportional to absolute temperature current mirror for sensing relative current flow through said first and said second current branches in said proportional to absolute temperature current mirror and for controlling said output means to maintain the regulated voltage constant; and a start up circuit responsive to the regulated voltage and coupled to said proportional to absolute temperature current mirror for initiating current flow through said first and said second current branches in said proportional to absolute temperature current mirror.

2. A voltage regulator according to claim 1 wherein said proportional to absolute temperature current mirror includes a cascoded current mirror.

3. A voltage regulator according to claim 2 wherein said cascoded current mirror includes first and second FET transistors in said first current branch of said proportional to absolute temperature current mirror and third and fourth FET transistors in said second current branch of said proportional to absolute temperature current mirror.

4. A voltage regulator according to claim 3 wherein said first, said second, said third and said fourth FET transistors are biased by said resistor string.

5. A voltage regulator according to claim 3 wherein said proportional to absolute temperature current mirror includes a fifth FET transistor in said first current branch in said proportional to absolute temperature current mirror and a sixth FET transistor in said second current branch in said proportional to absolute temperature current mirror.

6. A voltage regulator according to claim 1 wherein said output means include a pass transistor.

7. A voltage regulator according to claim 5 wherein said output means include a pass transistor.

8. A voltage regulator according to claim 1 wherein said first current branch in said proportional to absolute temperature current mirror includes a first plurality of three FET transistors connected in series and connected in series with a first transistor and said second current branch in said proportional to absolute temperature current mirror includes a second plurality of three FET transistors connected in series and connected in series with a second transistor.

9. A voltage regulator according to claim 2 wherein said first current branch in said proportional to absolute temperature current mirror includes a first plurality of three FET transistors connected in series and connected in series with a first transistor and said second current branch in said proportional to absolute temperature current mirror includes a second plurality of three FET transistors connected in series and connected in series with a second transistor.

10. A method of regulating a voltage comprising the steps of:

providing a proportional to absolute temperature current mirror having first and second branches;

developing separate current flows through said first and said second current branches of said proportional to absolute temperature current mirror;

establishing a bandgap voltage when current flow through said first and said second current branches of said proportional to absolute temperature current mirror is equal;

developing a regulated output voltage from the bandgap voltage;

supplying the regulated output voltage to a load and an output current to the load while maintaining the regulated output voltage constant;

sensing relative current flow through said first and said second current branches in said proportional to absolute temperature current mirror; and controlling the regulated output voltage to maintain the regulated voltage constant in response to the sensing of relative current flow through said first and said second current branches in said proportional to absolute temperature current mirror.

11. A voltage regulator according to claim 1 wherein said inverting gain stage is directly connected to said proportional to absolute temperature current mirror.

12. A voltage regulator according to claim 4 wherein said inverting gain stage is directly connected to said proportional to absolute temperature current mirror.

13. A voltage regulator according to claim 6 wherein said inverting gain stage is directly connected to said proportional to absolute temperature current mirror.

* * * * *